US005355673A

United States Patent [19]

Sterling et al.

[11] Patent Number: 5,355,673

[45] Date of Patent: Oct. 18, 1994

[54] EXHAUST VALVE

[76] Inventors: Robert E. Sterling, N. 22711 N. Glen Dr., Colbert, Wash. 99005; Mathew R. Sterling, W. 5727 Pacific Park, Spokane, Wash. 99208

[21] Appl. No.: 985,642

[22] Filed: Nov. 18, 1992

[51] Int. Cl.[5] ..... F01N 7/00

[52] U.S. Cl. ..... 60/324; 137/527; 251/303; 251/308

[58] Field of Search ..... 60/324; 137/496, 527; 251/287, 303, 308

[56] References Cited

U.S. PATENT DOCUMENTS

| | | | |
|---|---|---|---|
| 810,542 | 1/1906 | Kahlenberg . | |
| 955,979 | 4/1910 | Murphey | 251/308 |
| 1,055,270 | 3/1913 | Griffith . | |
| 1,163,128 | 12/1915 | Brauer . | |
| 1,330,265 | 2/1920 | Hinton | 251/303 |
| 1,365,852 | 1/1921 | Richmond . | |
| 1,375,621 | 4/1921 | Wright, Jr. . | |
| 1,613,322 | 1/1927 | Goetz | 137/527 |
| 1,818,796 | 8/1931 | Feyens | 181/38 |
| 2,072,372 | 3/1937 | Kingsley | 181/36 |
| 2,960,178 | 11/1960 | De Lorean | 181/50 |
| 3,234,924 | 2/1966 | May | 60/324 |
| 3,391,756 | 7/1968 | Larkfeldt et al. . | |
| 3,969,895 | 7/1976 | Krizman | 27/2 |
| 4,161,996 | 7/1979 | Dolejsi | 181/230 |
| 4,609,068 | 9/1986 | Backlund | 181/226 |
| 4,707,987 | 11/1987 | Atkin | 60/324 |
| 4,903,486 | 2/1990 | Finkle | 60/324 |

FOREIGN PATENT DOCUMENTS

| | | | |
|---|---|---|---|
| 479646 | of 1953 | Italy . | |
| 556847 | 2/1957 | Italy . | |
| 623754 | 8/1961 | Italy . | |
| 678619 | 9/1952 | United Kingdom | 251/308 |

*Primary Examiner*—Douglas Hart
*Attorney, Agent, or Firm*—Christensen, O'Connor, Johnson & Kindness

[57] ABSTRACT

An exhaust tube having an internal butterfly valve is coupled to the exhaust end of a conventional exhaust pipe extending from an internal combustion engine. The valve plate is mounted for swinging about an axis offset from the axis of the exhaust tube. The valve plate is spring-biased to a normal position substantially obstructing the exhaust tube. At high exhaust flow conditions, the valve plate is automatically swung to an open position in which flow through the exhaust tube is essentially unrestricted. Under back pressure conditions, the valve plate swings oppositely but still constitutes a substantial obstruction to exhaust flow. Consequently, the valve automatically opens at high flow conditions and automatically closes at low flow and back pressure conditions for more efficient operation of the internal combustion engine.

7 Claims, 4 Drawing Sheets

EXHAUST VALVE

FIELD OF THE INVENTION

The present invention relates to an exhaust system for an internal combustion engine including a flow-regulating valve responsive to pressure in the system.

BACKGROUND OF THE INVENTION

Performance and efficiency of internal combustion engines are affected by the characteristics of their exhaust systems. When designing an exhaust system, compromises must be made concerning engine performance at different speeds. For example, the exhaust system may be designed so that the engine will operate at maximum efficiency for maximum power and fuel economy at high engine speeds, at the sacrifice of performance and efficiency at low to medium engine speeds. Uneven idling also may result. For a static exhaust system, pressure downstream of the engine will vary with engine speed. Low or negative pressure helps to suck exhaust gas from the combustion chamber and, during valve overlap, to draw in a fresh fuel-air mixture. On the other hand, high positive pressure interferes with expulsion of exhaust gas from the engine and, during valve overlap, interferes with the incoming air-fuel mixture.

Particularly for high performance engines in which exhaust systems are designed to minimize pressure during valve overlap at high engine speeds for maximum power, exhaust systems have been proposed with special mufflers having throttle valves to restrict exhaust flow through the mufflers at low engine speeds in order to lessen or eliminate "back pressure." known systems are of complicated construction and/or have mechanical components that produce irritating rattles.

SUMMARY OF THE INVENTION

The present invention provides an exhaust valve that can be incorporated in an otherwise conventional exhaust system, preferably by coupling to the exhaust end of the conventional exhaust pipe. The unit has an internal butterfly valve which is spring-biased to an essentially closed position to restrict flow through the pipe. However, under high flow conditions the valve is swung against the force of the biasing spring to an open position in which flow is essentially unrestricted. Under back pressure conditions, the valve swings oppositely but still constitutes a substantial obstruction to exhaust flow. The mechanism mounting the butterfly valve is designed to operate without chattering or rattling and preferably is supported by a heat resistant bushing or sleeve at only one side of the unit such that twisting or warping of the exhaust pipe by the high operating temperatures will not interfere with efficient automatic operation of the valve.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
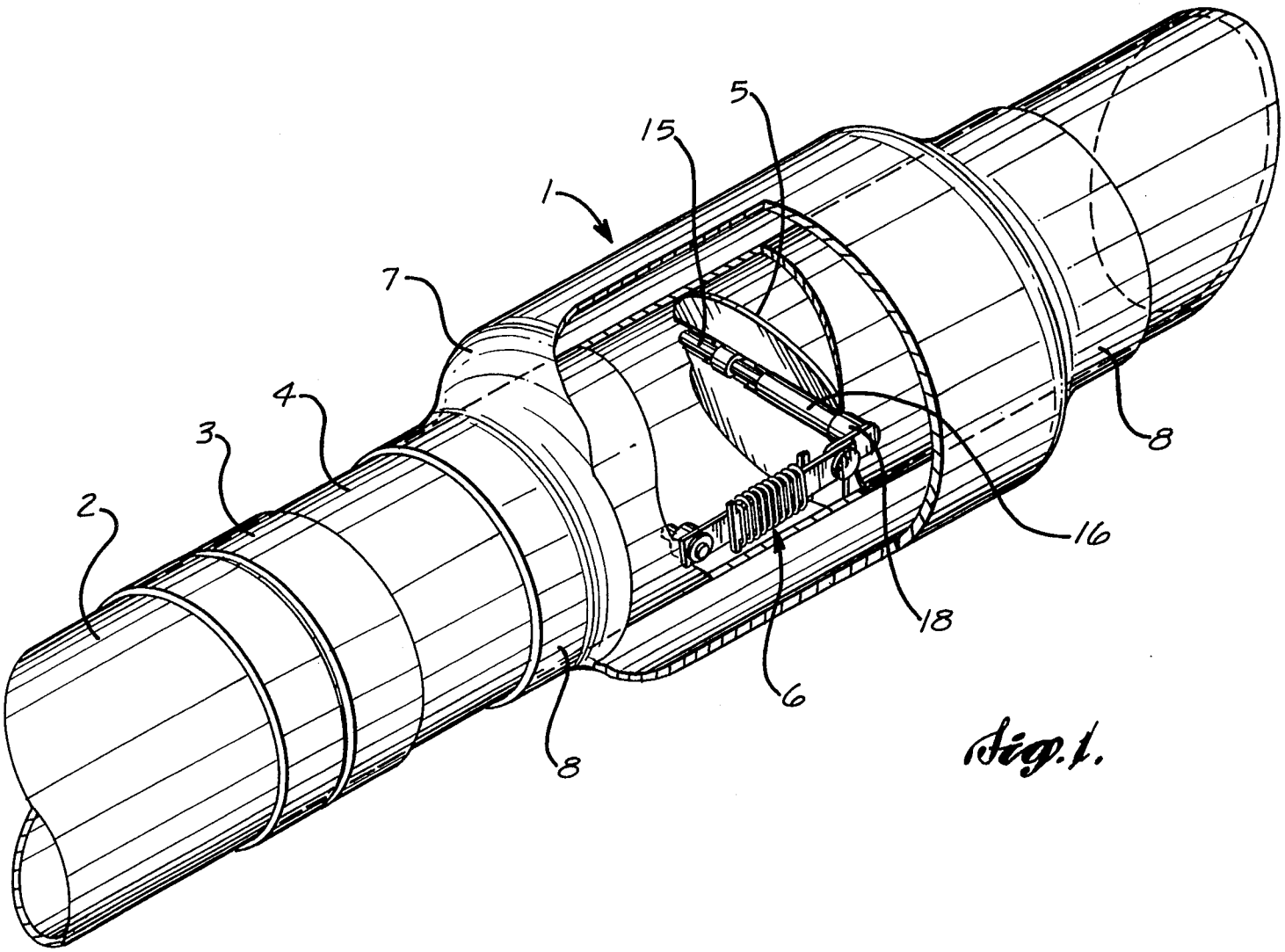
FIG. 1 is a top perspective of an exhaust valve in accordance with the present invention with parts broken away.

With reference to FIG. 1, the exhaust valve 1 in accordance with the present invention is coupled to the otherwise conventional exhaust system of an internal combustion engine. For example, valve 1 can be coupled to the end of a conventional exhaust pipe 2 by a standard fitting 3. Valve 1 includes an exhaust tube 4 and an internal adjustable flow-restricting member, preferably a modified butterfly valve plate 5. Plate 5 is a solid, unapertured disc. An external spring-biased linkage assembly 6 automatically controls the position of the valve plate. The linkage assembly preferably is enclosed in a larger outer tube 7 having opposite ends 8 swaged to the exhaust tube 4. Sufficient space is provided between the tubes 4 and 7 so as not to interfere with operation of the linkage, but tube 7 encloses the linkage and protects it from dirt, grime, grease, mud, flying stones or pebbles, and so on, to which it otherwise would be exposed. As described further below, the linkage assembly 6 controls the position of the valve plate 5 as a function of the pressure of gas in the exhaust tube 4 in such a way as to minimize the obstruction during high flow conditions and maximize the obstruction during low flow or back pressure conditions.

Figure 2:
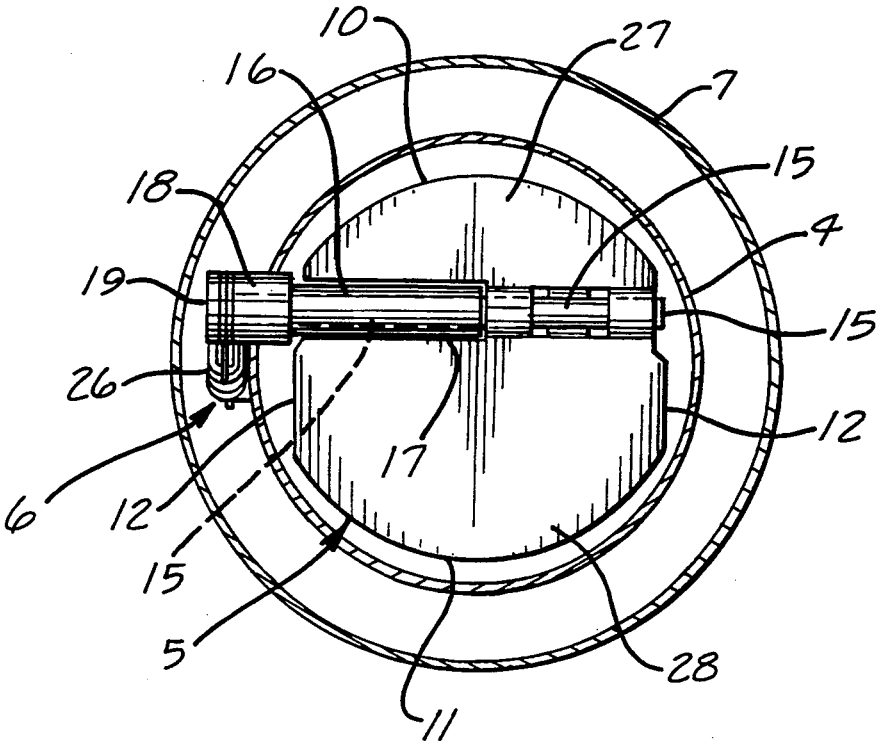
FIG. 2 is an end elevation of the exhaust valve of FIG. 1 with parts shown in section.

With reference to FIG. 2, the butterfly valve plate 5 is centered in the exhaust tube 4, but the transverse axis about which it rotates is not. Plate 5 has an arcuate top edge 10 which, in the illustrated central position of the plate, is closely adjacent to the inner periphery of the top of the exhaust tube. Plate 5 has a bottom arcuate edge 11 which, in such central position, is closely adjacent to the inner periphery of the bottom portion of the tube. The opposite side edges 12 of the valve plate are substantially linear and vertical but still are positioned close to the inner periphery of the side portions of the exhaust tube. Consequently, in the central position of the valve plate, the major portion of the internal area of the exhaust tube is obstructed, and any flow around the edges of the valve plate would tend to be turbulent so that the exhaust tube is essentially blocked.

Plate 5 is secured to one end portion of a horizontal shaft 15. Most of the other end portion of the shaft is rotatably journaled in an elongated horizontal bushing 16. Bushing 16 fits in a notch 17 of the valve plate such that the plate is swingable relative to the bushing by rotation of shaft 15. Bushing 16 has an outer end press fitted in a short sleeve 18. Sleeve 18 is fixed in a hole through the exhaust tube 4. The end of shaft 15 remote from the valve plate is fastened to a crank 19 rotatable relative to the stationary sleeve 18 at the exterior of the exhaust tube.

Figure 3:
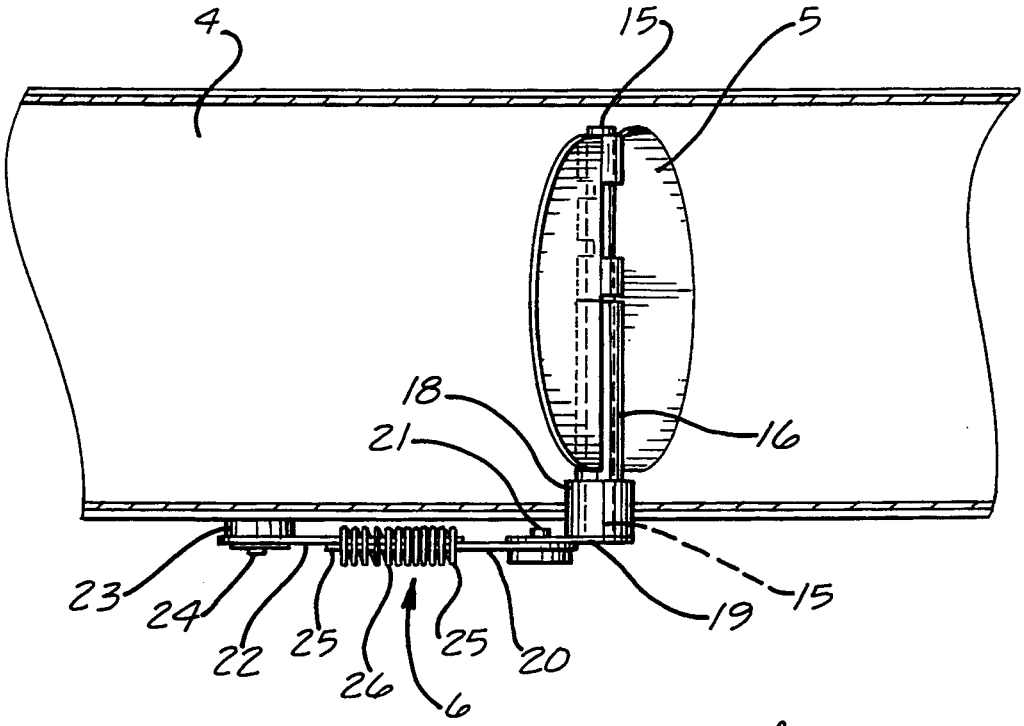
FIG. 3 is a top plan of the exhaust valve of FIG. 1 with parts broken away.
Figure 4:
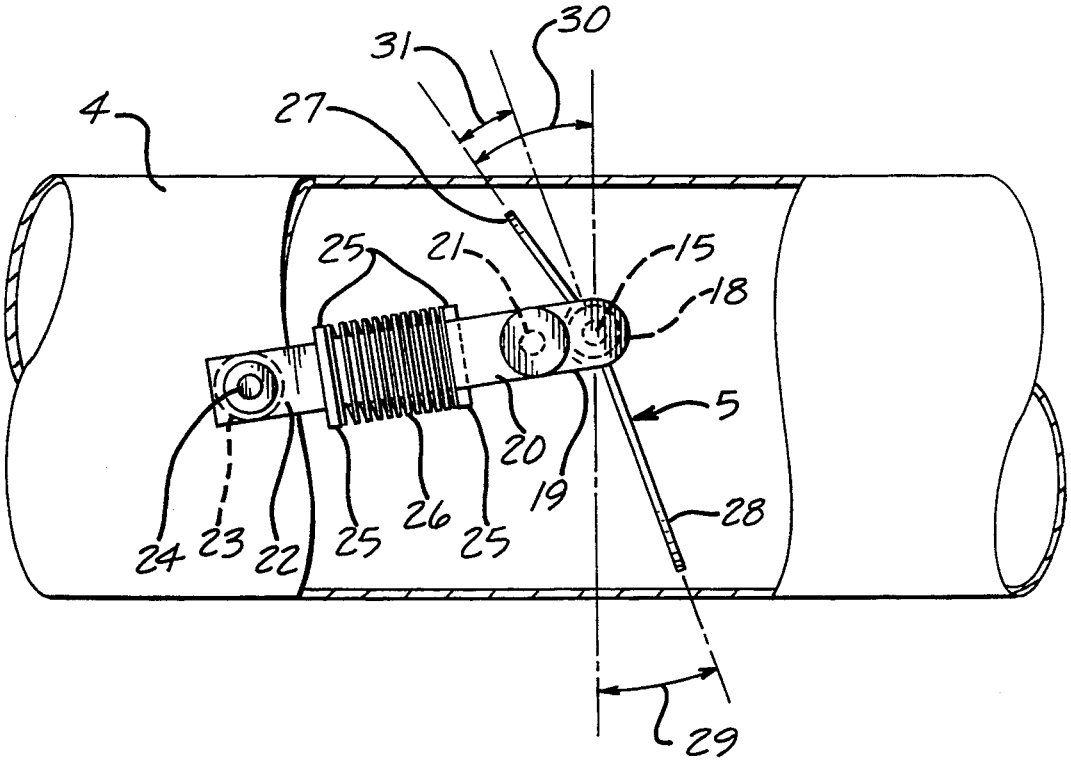
FIG. 4 is a side elevation of the exhaust valve of FIG. 1 with parts broken away.

With reference to FIG. 3 and FIG. 4, crank 19 is part of the linkage assembly 6 which determines the position of the valve plate 5. A first flat elongated link 20 has a trailing end portion pivotally connected to crank 19 by a pivot pin 21 at a location offset from the axis of the shaft 15. A second flat elongated link 22 has a leading end portion swingably connected to a short lug 23 projecting from the exhaust tube 4 by a pivot pin 24. The leading end portion of link 20 and the trailing end portion of link 22 overlap and extend parallel to each other. The overlapping ends of the links have transversely extending projections 25 which, as best seen in FIG. 4, form stops for the opposite ends of a compression spring 26. Spring 26 is of generally helical shape, except that each ring or loop of the helix is substantially rectangular to fit closely around the overlapping portions of links 20 and 22 between the stop projections 25.

As seen in FIG. 2 and FIG. 4, preferably the horizontal shaft 15 on which the valve plate 5 is mounted is positioned such that the distance from the shaft to the bottom of the tube 4 is approximately twice the distance from the shaft to the top of the tube. The shaft divides the valve plate into a flat upper portion 27 and a flat lower portion 28, with the lower portion 28 having an area many times greater than the area of the upper portion 27. In addition, as best seen in FIG. 4, in the central position of the valve plate the flat lower portion 28 extends downward and rearward from the axis of the shaft 15, toward the outlet end of the exhaust tube, at a small acute angle 29, preferably about 20°. In the preferred embodiment, the upper portion 27 of the valve plate is not coplanar with the lower portion 28. Rather, in the central position of the plate the upper portion extends upward and forward from the shaft 15, toward the inlet end of the exhaust tube, at a small acute angle 30 greater than the angle 29, preferably about 35°. Stated in another way, the preferred angle 31 of the flat upper portion 27 to the flat lower portion 28 is about 15°.

Figure 5:
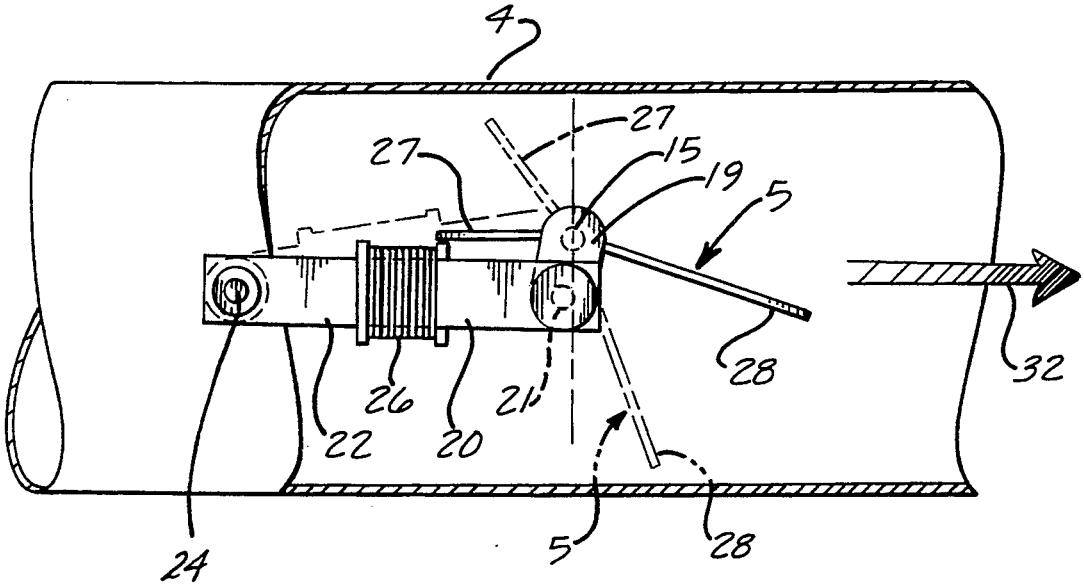
FIG. 5 and FIG. 6 are side elevations corresponding to FIG. 4, but with parts in different positions.

In FIG. 5 the normal direction of exhaust flow is indicated by the arrow 32. For a high flow condition, substantially greater force is exerted by the exhaust gas against the larger lower portion 28 of the plate than against the smaller upper portion 27. At high flow conditions the valve plate 5 is swung from the central position indicated in broken lines toward the full-open position indicated in solid lines. Opening swinging movement of the valve is limited by compression of the spring 26 to such a degree that the coils or loops of the helix become tightly engaged. In the preferred embodiment, the spring is constructed so as to allow approximately 55° of swinging movement of the valve plate. Consequently, in the most open position of the valve shown in solid lines in FIG. 5, the smaller upper plate portion 27 will extend substantially parallel to the length of the exhaust tube 4, and the lower portion 28 of the plate will be inclined slightly downward. In such position, there is very little resistance to exhaust flow through the tube.

Figure 6:
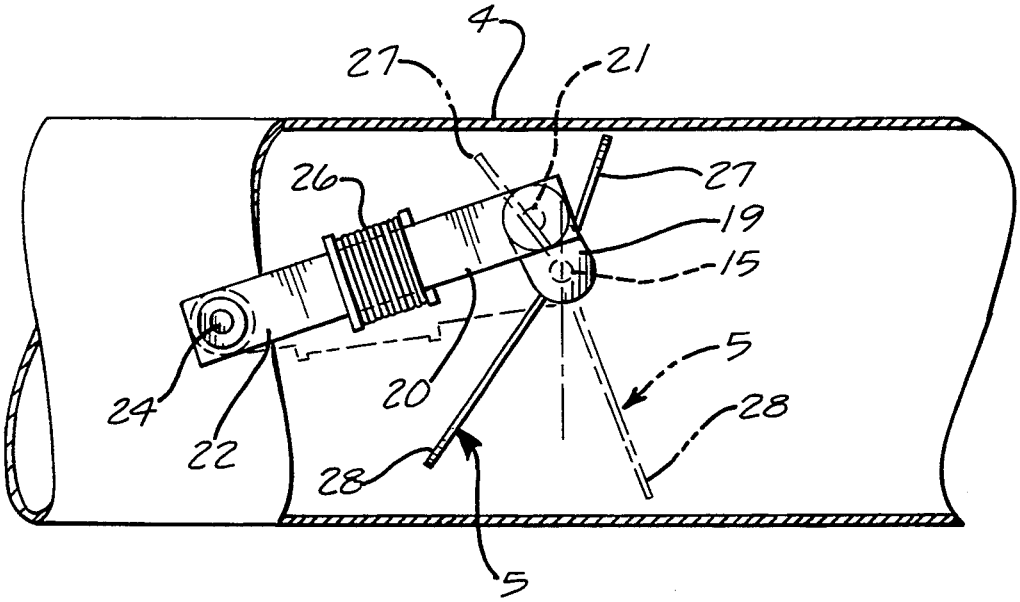

With reference to FIG. 6, in a back pressure condition, as can occur at low to medium engine speeds in a conventionally designed system, the valve plate is swung oppositely but, again, the maximum travel from the central position shown in broken lines in FIG. 6 is limited by the characteristics of the helical compression spring 26. As noted above, in the preferred embodiment the maximum travel of the valve plate from the central position is 55°. As seen in FIG. 6, in the maximum forwardly swung position (shown in solid lines), the exhaust tube 4 still is substantially blocked by the valve plate, and the close proximity of the edges of the plate to the inner periphery of the exhaust tube create turbulence in the flow. Thus, under all back pressure conditions the exhaust tube is essentially blocked by the valve plate 5, whereas in normal flow conditions the exhaust tube is opened increasingly for increasing exhaust flow. In a representative embodiment, internal pressure of about one and one-half pounds per square inch above atmospheric pressure in the exhaust tube 4 is sufficient to swing the valve plate from its central position to its most rearward or most forward swung position.

With reference to FIG. 1, often the conventional exhaust pipe 2 or other exhaust gas-conveying components of the exhaust system are thin-walled, metal material. Similarly, preferably the inner exhaust tube 4 is thin-walled, metal material equivalent to a conventional exhaust pipe. Heating of such material by exhaust gas passing through it can cause the material to twist or warp during extended operation of the associated internal combustion engine. In the present invention, preferably the short sleeve 18 and bushing 16 through which the valve shaft 15 extend are formed of a more heat-resistant material than the thin-walled pipe or tube. Consequently, even if the exhaust pipe 2, valve tube 4 or the fitting 3 connecting pipe 2 or tube 4 twists or warps during extended operation, the shaft 15 will not bind within the bushing 16 and sleeve 18, and the valve will continue to operate efficiently. On the other hand, if the shaft 15 were supported at both sides of the tube 4, twisting or warping of the tube could cause the shaft 15 to bind such that the valve plate would be stuck in one position and not operate as intended.

For all positions of the valve plate, the spring of the linkage assembly exerts a positive force on the mechanical components. As a result, all components are held relative to each other and there is little likelihood of chattering or rattling. The system remains quiet regardless of the operating speed or rapid fluctuations in exhaust flow or pressure.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A valve for the exhaust system of an internal combustion engine comprising an elongated exhaust tube for conducting engine exhaust therethrough and having an inlet end and an outlet end, a valve plate, and mechanical means for movably mounting said valve plate in said tube and for normally positioning said valve plate in a central position substantially obstructing said tube, said mechanical mounting means including means for automatically adjusting the position of said valve plate in said tube in response to flow of exhaust through said tube from said inlet end to said outlet end for movement of said valve plate from said central position to an open position in which said tube is substantially unobstructed, said valve plate having a first portion and a second portion substantially smaller than and angled relative to said first portion, said mechanical mounting means including means for automatically swinging said valve plate in a first direction from the normal central position toward the open position in response to exhaust flow through said exhaust tube creating greater pressure at the inlet side of said valve plate than at the outlet side of said valve plate and for automatically swinging said valve plate in the opposite direction from the normal central position, away from the open position, in response to exhaust flow through said tube creating greater pressure at the outlet end side of said valve plate than at the inlet end side of said valve plate, said mechanical mounting means including a shaft having a portion secured to said valve plate and means rotatably supporting said shaft at only one side of said exhaust tube for mounting said valve plate for swinging about an axis extending transversely of said exhaust tube, a crank connected to said shaft at the exterior of said exhaust tube and a mechanical linkage assembly limiting the maximum degree of travel of said valve plate in both directions from said central position, said mechanical linkage assembly including a pair of links including a first link pivotally connected to said crank and a second link pivotally connected to said exhaust tube, said two links having overlapping end portions.

2. The valve defined in claim 1, including a spring encircling the overlapping end portions of the links for biasing the valve plate to the normal central position.

3. The valve defined in claim 1, in which the mechanical linkage assembly limits swinging of the valve plate in the first direction to an angle of less than 90°.

4. The valve defined in claim 3, in which the mechanical linkage assembly limits swinging of the valve plate in a direction opposite the first direction to an angle approximately equal to the angle of maximum swinging of the valve plate in the first direction.

5. The valve defined in claim 1, in which the valve plate is an unapertured solid disk.

6. The valve defined in claim 1, in which the first and second portions extend, respectively, oppositely from the swinging axis of the valve plate.

7. The valve defined in claim 6, in which the second portion of the valve plate is angled from the swinging axis of the valve plate outward to the periphery of the exhaust tube and toward the inlet and of the exhaust tube when the valve plate is in its normal central position.

* * * * *

UNITED STATES PATENT AND TRADEMARK OFFICE

CERTIFICATE OF CORRECTION

PATENT NO. : 5,355,673

DATED : October 18, 1994

INVENTOR(S) : R.E. Sterling et al.

It is certified that error appears in the above-indentified patent and that said Letters Patent is hereby corrected as shown below:

| COLUMN | LINE | |
|---|---|---|
| On the title page, item [56] (Pg. 1, Col. 1) | Other Publications | Insert --*Popular Science*, January 1990, "Smart Exhaust," p. 86.-- |
| 1 | 34 | "known" should read --Known-- |

Signed and Sealed this

Twenty-first Day of February, 1995

*Attest:*

*Attesting Officer*

BRUCE LEHMAN

*Commissioner of Patents and Trademarks*